US009819084B2

(12) United States Patent
Zimmerman et al.

(10) Patent No.: US 9,819,084 B2
(45) Date of Patent: Nov. 14, 2017

(54) METHOD OF ELIMINATING RESONANCES IN MULTIBAND RADIATING ARRAYS

(71) Applicant: CommScope Technologies, LLC, Hickory, NC (US)

(72) Inventors: Martin Lee Zimmerman, Chicago, IL (US); Peter J. Bisiules, LaGrange Park, IL (US)

(73) Assignee: CommScope Technologies LLC, Hickory, NC (US)

( * ) Notice: Subject to any disclaimer, the term of this patent is extended or adjusted under 35 U.S.C. 154(b) by 174 days.

(21) Appl. No.: 14/683,424

(22) Filed: Apr. 10, 2015

(65) Prior Publication Data

US 2015/0295313 A1 Oct. 15, 2015

Related U.S. Application Data

(60) Provisional application No. 61/978,791, filed on Apr. 11, 2014.

(51) Int. Cl.
*H01Q 21/00* (2006.01)
*H01Q 5/48* (2015.01)
(Continued)

(52) U.S. Cl.
CPC ..... *H01Q 5/48* (2015.01); *H01Q 1/246* (2013.01); *H01Q 1/50* (2013.01); *H01Q 5/42* (2015.01);
(Continued)

(58) Field of Classification Search
USPC ..... 343/702, 700 MS, 810, 821
See application file for complete search history.

(56) References Cited

U.S. PATENT DOCUMENTS 3,922,683 A * 11/1975 Kumpebeck ..... H01Q 5/48 343/797
5,818,385 A * 10/1998 Bartholomew ..... H01Q 1/246 342/372

(Continued)

FOREIGN PATENT DOCUMENTS

FR 2 863 111 A1 6/2005
WO WO 2007/011205 A1 1/2007

OTHER PUBLICATIONS

Notification Concerning Transmittal of International Preliminary Report on Patentability Corresponding to International Application No. PCT/US2015/025284; dated Oct. 20, 2016; 8 Pages.

(Continued)

*Primary Examiner* — Jessica Han
*Assistant Examiner* — Hai Tran
(74) *Attorney, Agent, or Firm* — Myers Bigel, P.A.

(57) ABSTRACT

A multiband radiating array according to the present invention includes a vertical column of lower band dipole elements and a vertical column of higher band dipole elements. The lower band dipole elements operate at a lower operational frequency band, and the lower band dipole elements have dipole arms that combine to be about one half of a wavelength of the lower operational frequency band midpoint frequency. The higher band dipole elements operate at a higher frequency band, and the higher band dipole elements have dipole arms that combine to be about three quarters of a wavelength of the higher operational frequency band midpoint frequency. The higher band radiating elements are supported above a reflector by higher band feed boards. A combination of the higher band feed boards and higher band dipole arms do not resonate in the lower operational frequency band.

17 Claims, 12 Drawing Sheets

(51) Int. Cl.

| | |
|---|---|
| ***H01Q 9/18*** | (2006.01) |
| ***H01Q 5/50*** | (2015.01) |
| ***H01Q 1/50*** | (2006.01) |
| ***H01Q 1/24*** | (2006.01) |
| ***H01Q 21/26*** | (2006.01) |
| ***H01Q 5/42*** | (2015.01) |

(52) U.S. Cl.
CPC ..... *H01Q 5/50* (2015.01); *H01Q 9/18* (2013.01); *H01Q 21/26* (2013.01)

(56) References Cited

U.S. PATENT DOCUMENTS

| | | | | |
|---|---|---|---|---|
| 6,034,649 | A | 3/2000 | Wilson et al. | |
| 6,323,820 | B1 * | 11/2001 | Haunberger | H01Q 9/16 343/793 |
| 2003/0058184 | A1 * | 3/2003 | Barna | H03H 7/383 343/821 |
| 2006/0273865 | A1 * | 12/2006 | Timofeev | H01Q 1/246 333/161 |
| 2009/0135078 | A1 | 5/2009 | Lindmark et al. | |

OTHER PUBLICATIONS

International Search Report regarding related international application PCT/US2015/025284, dated Jul. 3, 2015 (4 pgs.).
Written Opinion regarding related international application PCT/US2015/025284, dated Jul. 3, 2015 (5 pgs.).

* cited by examiner

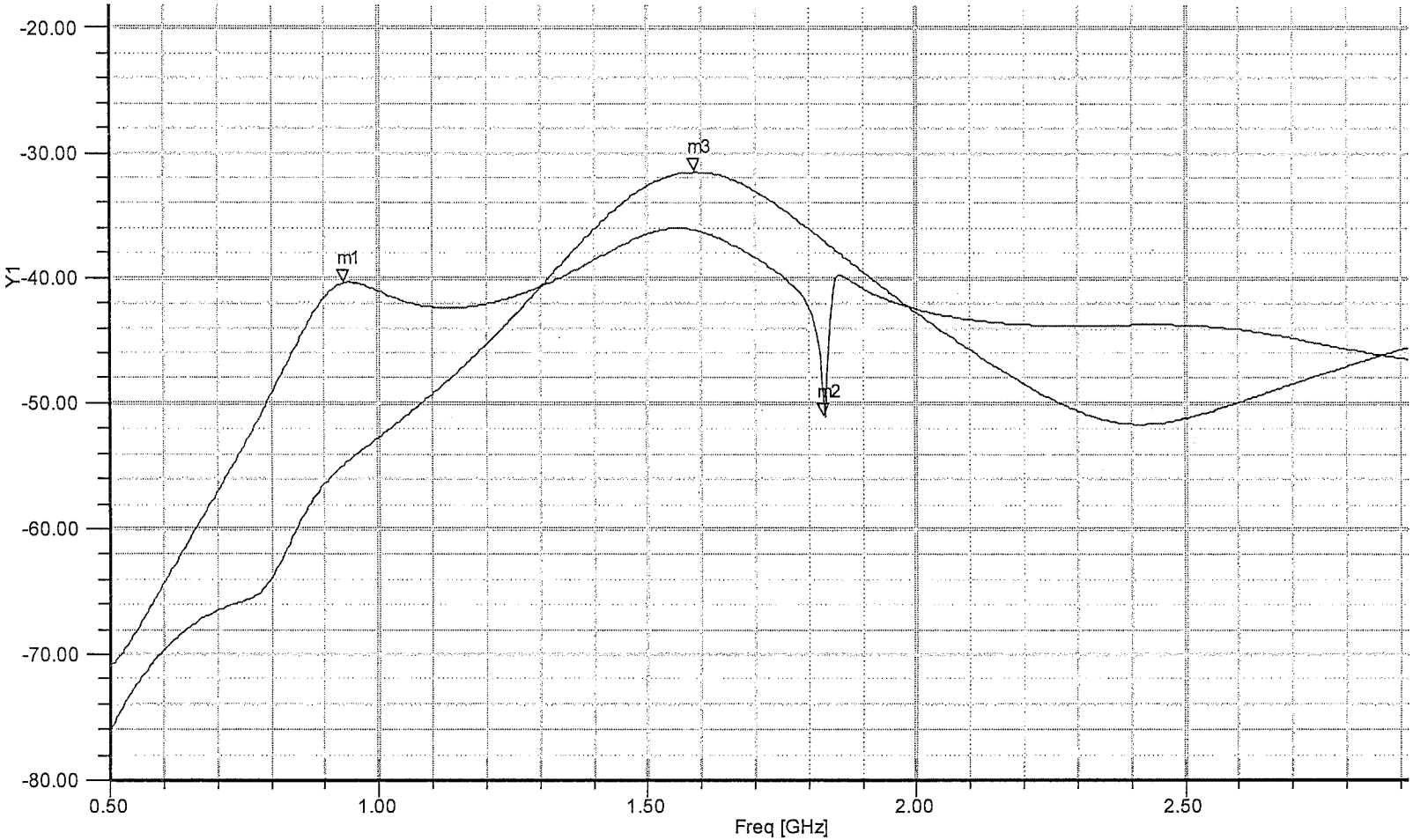
Fig. 3 – Half wave Dipole

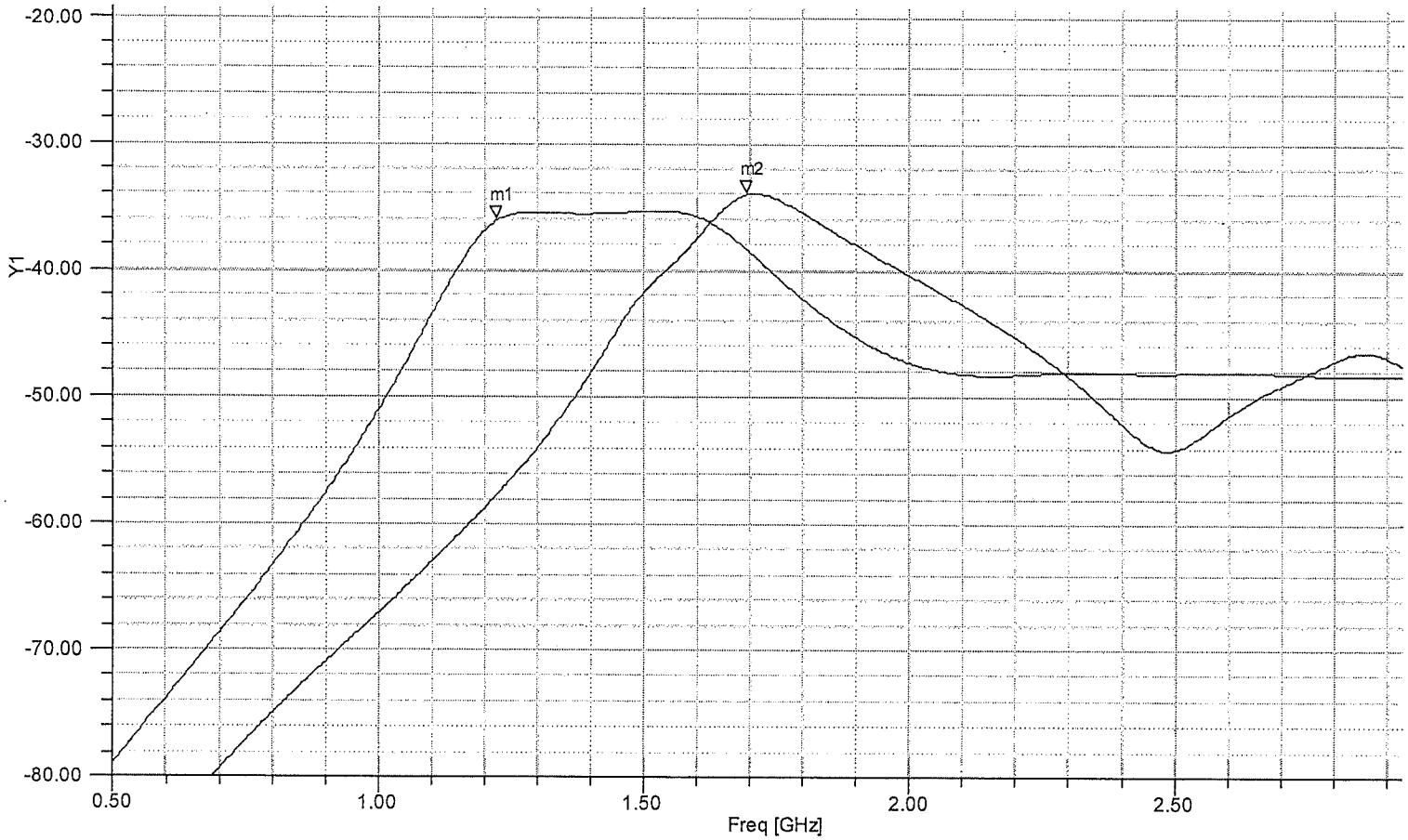
Fig. 4 – High Impedance Dipole

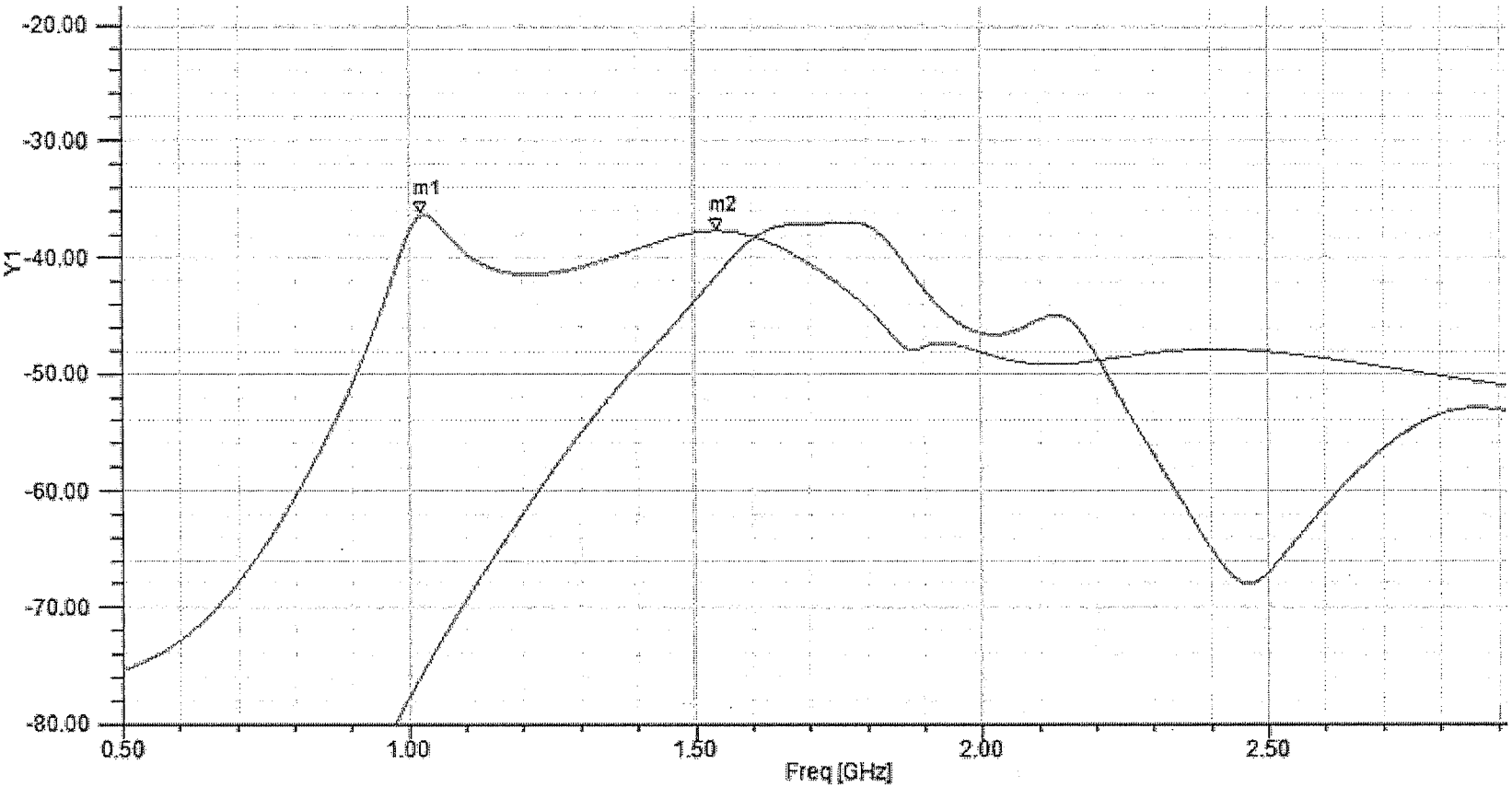
Fig. 5 – High Impedance Cross Dipole

Section A-A

Section A-A

METHOD OF ELIMINATING RESONANCES IN MULTIBAND RADIATING ARRAYS

RELATED APPLICATIONS

This application claims priority to U.S. Provisional Patent Application No. 61/978,791 filed Apr. 11, 2014, and titled "Method Of Eliminating Resonances In Multiband Radiating Arrays" the entire disclosure of which is incorporated by reference.

BACKGROUND

Multiband antennas for wireless voice and data communications are known. For example, common frequency bands for GSM services include GSM900 and GSM1800. A low band of frequencies in a multiband antenna may comprise a GSM900 band, which operates at 880-960 MHz. The low band may also include Digital Dividend spectrum, which operates at 790-862 MHz. Further, the low band may also cover the 700 MHz spectrum at 698-793 MHz.

A high band of a multiband antenna may comprise a GSM1800 band, which operates in the frequency range of 1710-1880 MHz. A high band may also include, for example, the UMTS band, which operates at 1920-2170 MHz. Additional bands may comprise LTE2.6, which operates at 2.5-2.7 GHz and WiMax, which operates at 3.4-3.8 GHz.

When a dipole element is employed as a radiating element, it is common to design the dipole so that its first resonant frequency is in the desired frequency band. To achieve this, the dipole arms are about one quarter wavelength, and the two dipole arms together are about one half the wavelength of the desired band. These are commonly known as "half-wave" dipoles. Half wave dipoles are fairly low impedance, typically in the range of 73-7552.

However, in multiband antennas, the radiation patterns for a lower frequency band can be distorted by resonances that develop in radiating elements that are designed to radiate at a higher frequency band, typically 2 to 3 times higher in frequency. For example, the GSM1800 band is approximately twice the frequency of the GSM900 band.

There are two modes of distortion that are typically seen, Common Mode resonance and Differential Mode resonance. Common Mode (CM) resonance occurs when the entire higher band radiating structure resonates as if it were a one quarter wave monopole. Since the vertical structure of the radiator (the "feed board") is often one quarter wavelength long at the higher band frequency and the dipole arms are also one quarter wavelength long at the higher band frequency, this total structure is roughly one half wavelength long at the higher band frequency. Where the higher band is about double the frequency of the lower band, because wavelength is inversely proportional to frequency, the total high band structure will be roughly one quarter wavelength long at a lower band frequency. Differential mode occurs when each half of the dipole structure, or two halves of orthogonally-polarized higher frequency radiating elements, resonate against one another.

One known approach for reducing CM resonance is to adjust the dimensions of the higher band radiator such that the CM resonance is moved either above or below the lower band operating range. For example, one proposed method for retuning the CM resonance is to use a "moat". See, for example, U.S. patent application Ser. No. 14/479,102, the disclosure of which is incorporated by reference. A hole is cut into the reflector around the vertical section of the radiating element (the "feedboard"). A conductive well is inserted into the hole and the feedboard is extended to the bottom of the well. This lengthens the feedboard, which moves the CM resonance lower and out of band, while at the same time keeping the dipole arms approximately one quarter wavelength above the reflector. This approach, however, entails extra complexity and manufacturing cost.

SUMMARY OF THE INVENTION

This disclosure covers alternate structures to retune the CM frequency out of the lower band. One aspect of the present invention is to use a high-impedance dipole as the radiating element for the high band element of a multi-band antenna. Unlike a half-wave dipole, a high impedance element is designed such that its second resonant frequency is in the desired frequency band. The impedance of a dipole operating in its second resonant frequency is about 400Ω-600Ω typically. In such a high impedance dipole, the dipole arms are dimensioned such that the two dipole arms together span about three quarters of a wavelength of the desired frequency. In another aspect, the dipole arms of the high impedance dipole couple capacitively to the feed lines on the vertical stalks.

A multiband radiating array according to the present invention includes a vertical column of lower band dipole elements and a vertical column of higher band dipole elements. The lower band dipole elements operate at a lower operational frequency band. The higher band dipole elements operate at a higher frequency band, and the higher band dipole elements have dipole arms that combine to be about three quarters of a wavelength of the higher operational frequency band midpoint frequency. The higher band radiating elements are supported above a reflector by higher band feed boards. A combination of the higher band feed boards and higher band dipole arms do not resonate in the lower operational frequency band.

Such higher band dipole arms resonate at a second resonant frequency in the higher operational frequency band, not at a first resonant frequency such as a half-wave dipole. The lower operational frequency band may be about 790 MHz-960 MHz. The higher operational frequency band may be about 1710 MHz-2170 MHz or, in ultra-wideband applications, about 1710 MHz-2700 MHz. The present invention may be most advantageous when the higher operational frequency band is about twice the lower operational frequency band.

In one aspect of the invention, the dipole arms of the higher band radiating elements are capacitively coupled to feed lines on the higher band feed boards. For example, the higher band feed board include a balun and a pair of feed lines, wherein each feed line is capacitively coupled to an inductive section, and each inductive section is capacitively coupled to a dipole arm. This separates the dipoles from the stalks at low band frequencies so they do not resonate as a monopole.

In another aspect of the invention, a radiating element includes first and second dipole arms supported by a feedboard. Each dipole arm has a capacitive coupling area. The feedboard includes a balun and first and second CLC matching circuits coupled to the balun. The first matching circuit is capacitive coupled to the first dipole arm and the second matching circuit is capacitively coupled to the second dipole arm. The first and second matching circuits each comprise a CLC matching circuit having, in series, a stalk, coupled to the balun, a first capacitive element, an inductor, and a second capacitive element, the second capacitive element being coupled to a dipole arm. The capacitive elements may be selected to block out-of-band induced currents.

The capacitors of the CLC matching circuits may be shared across different components. For example, the first capacitive element and an area of the stalk may provide the parallel plates of a capacitor, and the feedboard PCB substrate may provide the dielectric of a capacitor. The second capacitive element may combine with and capacitive coupling area of the dipole arm to provide the second capacitor.

BRIEF DESCRIPTION OF THE DRAWINGS

FIG. 3 is a graph of Common Mode and Differential Mode responses of the prior art dual band antenna of FIG. 1.

FIG. 4 is a graph of Common Mode and Differential Mode responses of dual band antenna according to one aspect of the present invention as illustrated in FIG. 2*b*.

FIG. 5 is a graph of Common Mode and Differential Mode responses of cross dipole dual band antenna according to one aspect of the present invention as illustrated in FIG. 2*b*.

DETAILED DESCRIPTION OF THE INVENTION

Figure 1:
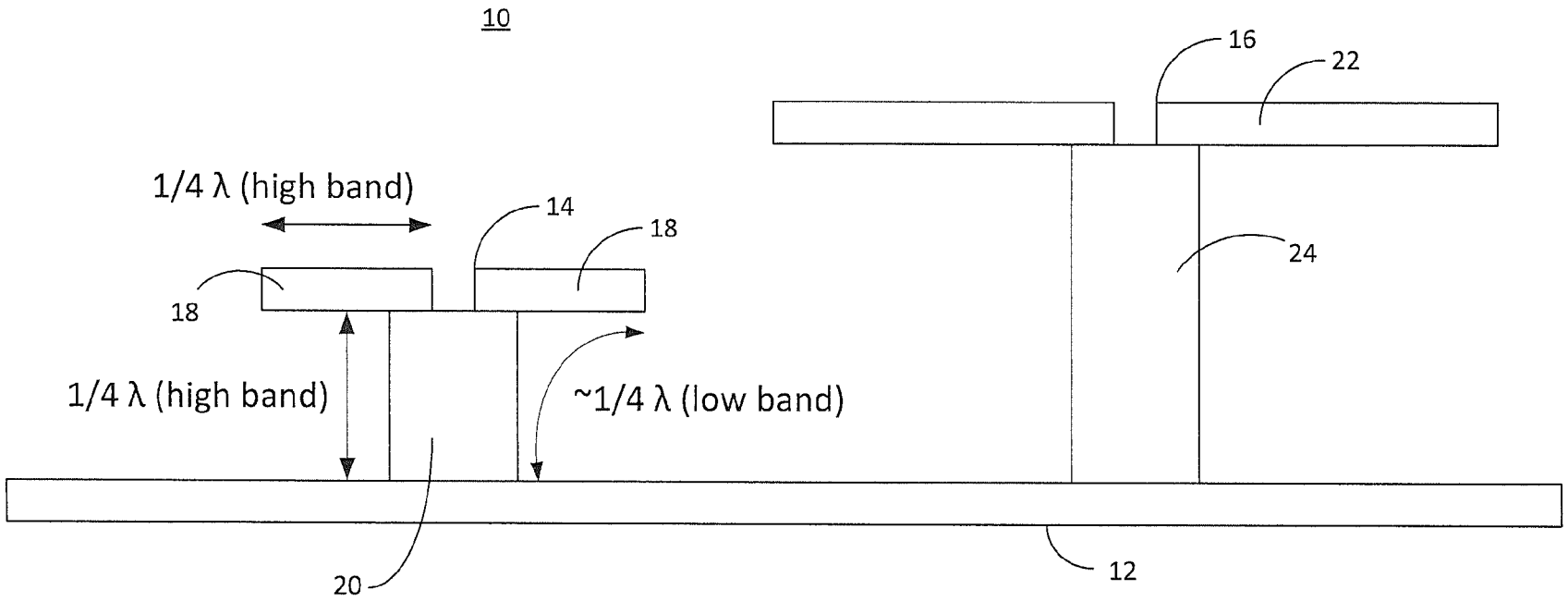
Fig. 1 (Prior Art)
FIG. 1 schematically diagrams a conventional dual band antenna 10.

FIG. 1 schematically diagrams a conventional dual band antenna 10. The dual band antenna 10 includes a reflector 12, a conventional high band radiating element 14 and a conventional low band radiating element 16. Multiband radiating arrays of this type commonly include vertical columns of high band and low band elements spaced at about one-half wavelength to one wavelength intervals. The high band radiating element 14 comprises a half-wave dipole, and includes first and second dipole arms 18 and a feed board 20. Each dipole arm 18 is approximately one-quarter wavelength long at the midpoint of the high band operating frequency. Additionally, the feed board 20 is approximately one-quarter wavelength long at the high band operating frequency.

The low band radiating element 16 also comprises a half-wave dipole, and includes first and second dipole arms 22 and a feed board 24. Each dipole arm 22 is approximately one-quarter wavelength long at the low band operating frequency. Additionally, the feed board 24 is approximately one-quarter wavelength long at the low band operating frequency.

In this example, the combined structure of the feed board 20 (one-quarter wavelength) and dipole arm 18 (one-quarter wavelength) is approximately one-half wavelength at the high band frequency. Since the high band frequency is approximately twice the low band frequency, and wavelength is inversely proportional to frequency, this means that the combined structure also is approximately one-quarter wavelength at the low band operating frequency. As illustrated in FIG. 3, with such a conventional half-wave dipoles, CM resonance (ml) occurs in the critical 700-1000 MHz region, which is where the GSM900 band and Digital Dividend band are located.

Figure 2A:
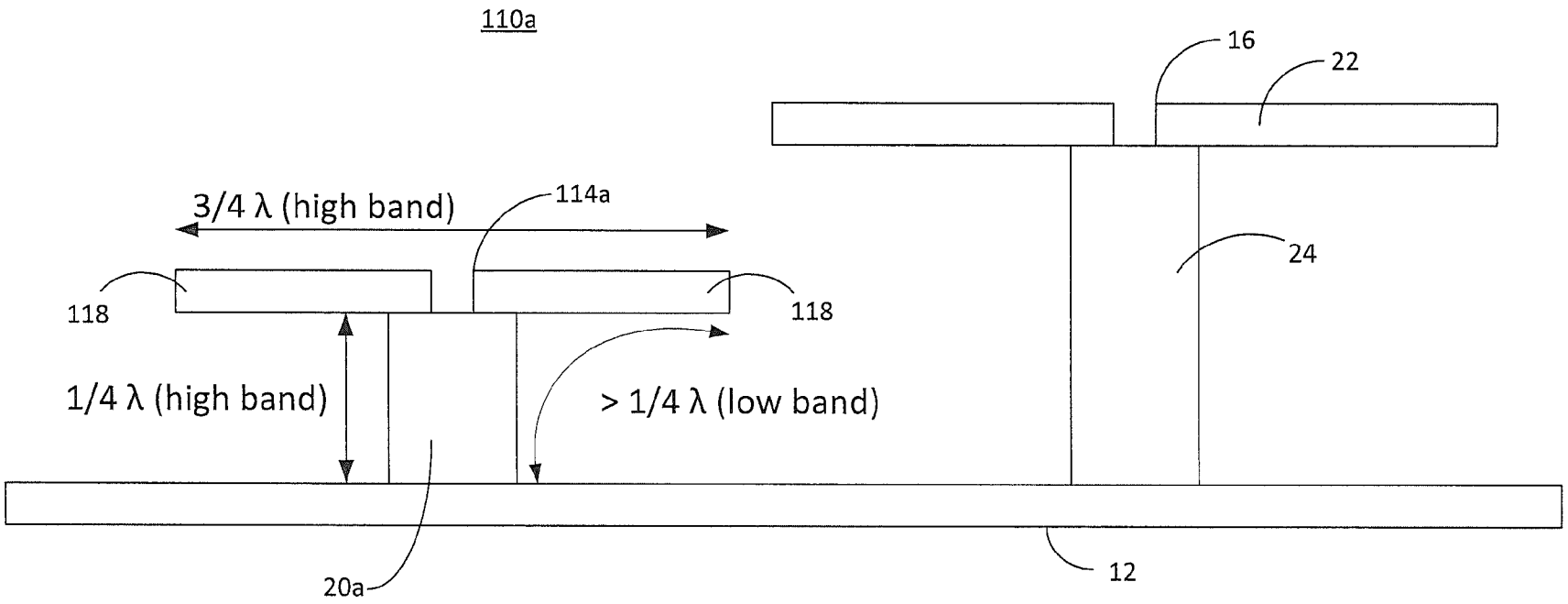
FIG. 2*a* schematically diagrams a first example of a dual band antenna according to one aspect of the present invention.

FIG. 2*a* schematically diagrams a dual band antenna 110 according to one aspect of the present invention. The dual band antenna 110*a* includes a reflector 12, a high band radiating element 114*a* and a conventional low band radiating element 16. The low band element 16 is the same as in FIG. 1, the description of which is incorporated by reference.

The high band radiating element 114*a* comprises a high impedance dipole, and includes first and second dipole arms 118 and a feed board 20*a*. In a preferred embodiment, the dipole arms 118 of the high band radiating element 114*a* are dimensioned such that the aggregate length of the dipoles arms 118 is approximately three-fourths wavelength of the center frequency of the high band. In wide-band operation, the length of the dipoles may range from 0.6 wavelength to 0.9 wavelength of any given signal in the higher band. Additionally, the feed board 20*a* is approximately one-quarter wavelength long at the high band operating frequency, keeping the radiating element 114*a* at the desired height from the reflector 12. In an additional embodiment, a full wavelength, anti-resonant dipole may be employed as the high-impedance radiating element 114*a*.

In the embodiments of the present invention disclosed above, the combination of the feed board 20*a* and high impedance dipole arm 118 exceeds one-quarter of a wavelength at low band frequencies. Lengthening the combination of the feed board and dipole arm lengthens the monopole, and tunes CM frequency down and out of the lower band.

Figure 2B:
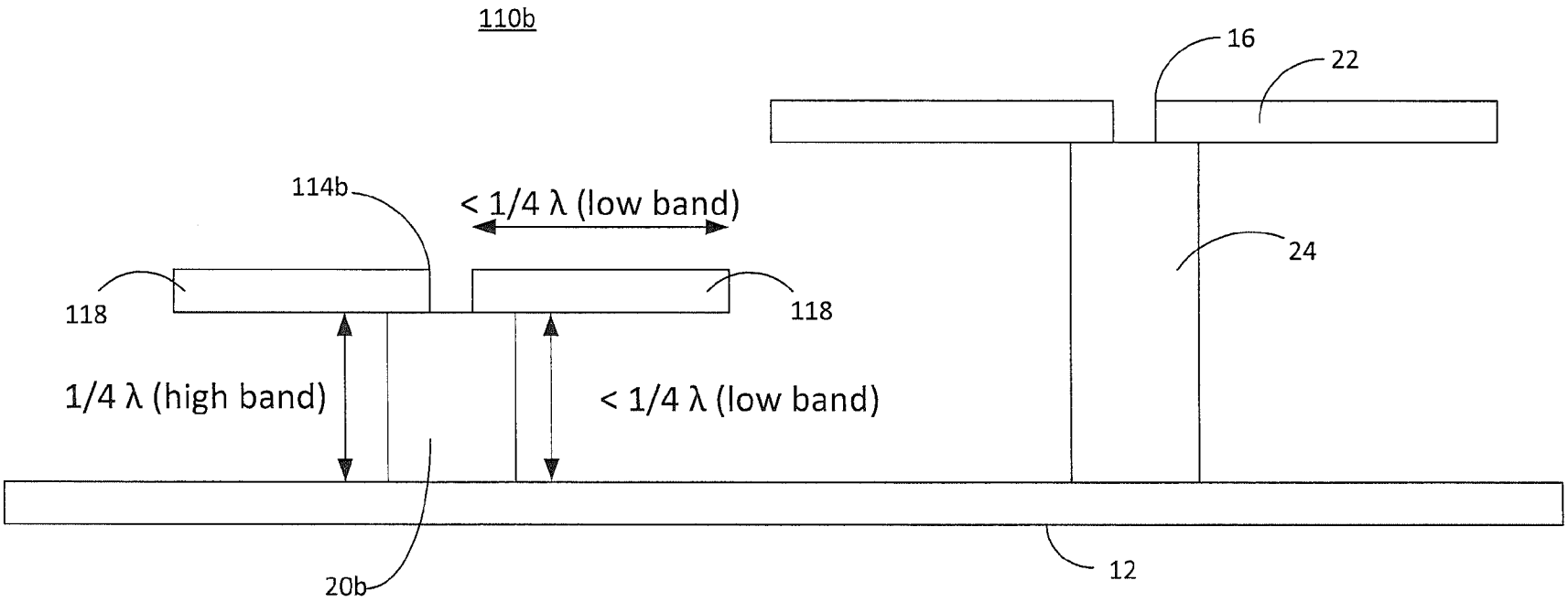
FIG. 2*b* schematically illustrates a second example of a dual band antenna according to one aspect of the present invention.
Figure 6:
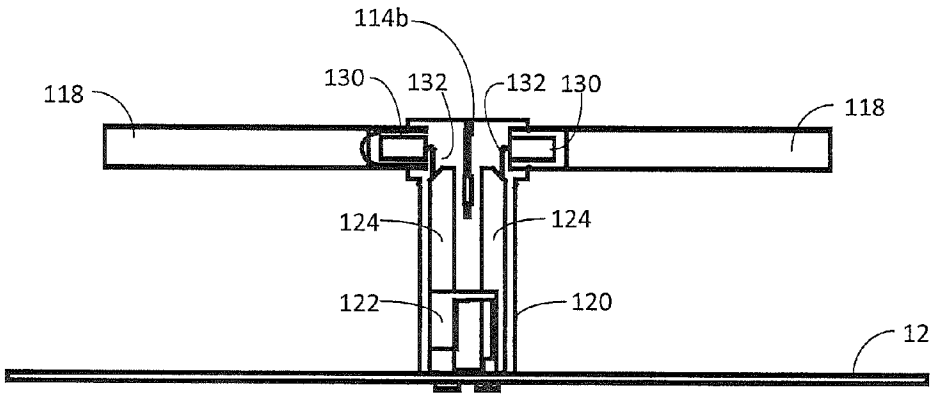
FIG. 6 is a high impedance dipole with capacitively coupled dipole arms according to another aspect of the present invention.

In another example, tuning the CM frequency up and out of the lower band may be desired. This example preferably includes capacitively-coupled dipole arms on the high band, high impedance dipole arms 118. FIG. 6 illustrates an example of a high impedance dipole 114*b* where the dipole arms 118 are capacitively coupled to the feed lines 124 on the feed boards 120. The feed boards 120 include a hook balun 122 to transform an input RF signal from single-ended to balanced. Feed lines 124 propagate the balanced signals up to the radiators. Capacitive areas 130 on a PCB couple to the dipoles 118. Inductive traces 132 couple the feed lines 124 to the capacitive areas 130. See, e.g., U.S. application Ser. No. 13/827,190, which is incorporated by reference. The capacitive areas 130 act as an open circuit at lower band frequencies. Accordingly, as illustrated in FIG. 2*b*, the dipole arm 118 and feedboard 20*b* no longer operate as a monopole at low band frequencies of interest. Each structure is independently smaller than ¼ wavelength at low band frequencies. Thus, CM resonance is moved up and out of the lower band.

Another aspect of the present invention is to provide an improved feed board matching circuit to reject common mode resonances. For the reasons set forth above, capacitive coupling is desirable, but an inductive section must be included to re-tune the feedboard once the capacitance is added. However, when the inductor sections 132 are connected to the feed lines 124, the inductor sections 132 coupled with feed lines 124 tend to extend the overall length of the monopole that this high band radiator forms. This may produce an undesirable common mode resonance in the low band.

Figure 7:
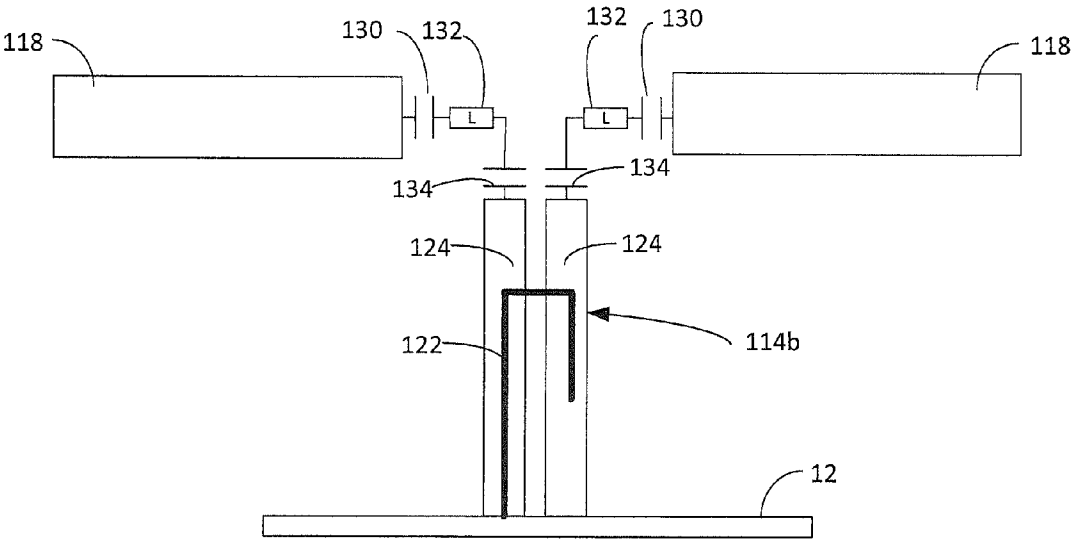
FIG. 7 is a schematic diagram of the high impedance dipole radiating element with a capacitively coupled matching circuit according to another aspect of the present invention.
Figure 8C:
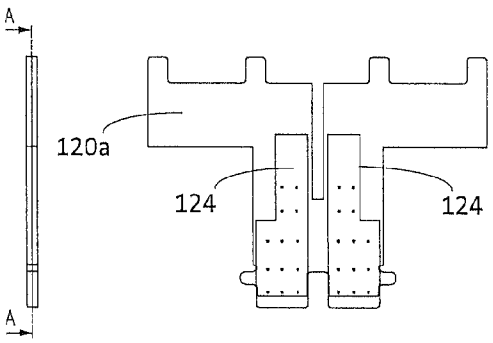
FIGS. 8*a*-8*c* illustrate radiating element feed boards according to another aspect of the present invention.
Figure 8B:
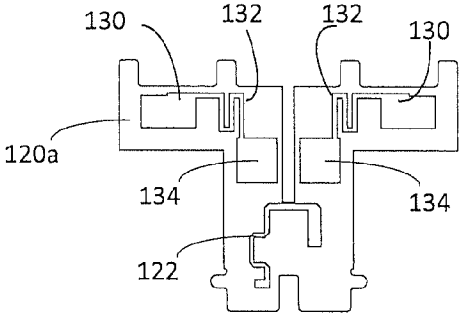
Figure 8A:
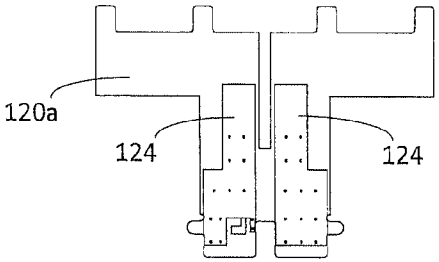

Additional examples illustrated in FIGS. 7, 8*a*-8*c* and 9*a*-9*c* improve the LC matching circuit by adding an extra capacitor section in the matching section (using a CLC matching section instead of an LC matching section). Referring to FIGS. 8*a*-8*c*, three metallization layers of a feed board 120*a* are illustrated. A first outer layer is illustrated in FIG. 8*a*, an inner layer is illustrated in FIG. 8*b*, and a second outer layer is illustrated in FIG. 8*c*. The first and second outer layers (FIGS. 8*a*, 8*c*) implement the feed lines 124. The inner layer (FIG. 8*b*) implements hook balun 122, first capacitor sections 134, inductive elements 132, and second capacitor sections 130. The first capacitor sections 134 couple to the feed lines 124 capacitively rather than directly connecting the inductive elements 132 to the feed lines 124. The second capacitor sections 130 are similar to the capacitor from the LC matching circuit illustrated in FIG. 6.

The first capacitor section 134 is introduced to couple capacitively from the feed lines 124 to the inductive sections 132 at high band frequencies where the dipole is desired to operate and acts to help block some of the low band currents from getting to the inductor sections 132. This helps reduce the effective length of the monopole that the high band radiator forms in the lower frequency band and therefore pushes the Common Mode Resonance Frequency higher so that it is up out of the desired low band frequency range. For example, FIG. 4 illustrates that the CM resonance (ml) is moved significantly higher by replacing the standard one-half wavelength radiating element 14 with a high-impedance radiating element 114. In addition to single-polarized dipole radiating elements, the present invention may be practiced with cross dipole radiating elements. FIG. 5 illustrates that the CM resonance is moved out of the low band frequency range when a high-impedance cross dipole is employed.

Figure 9B:
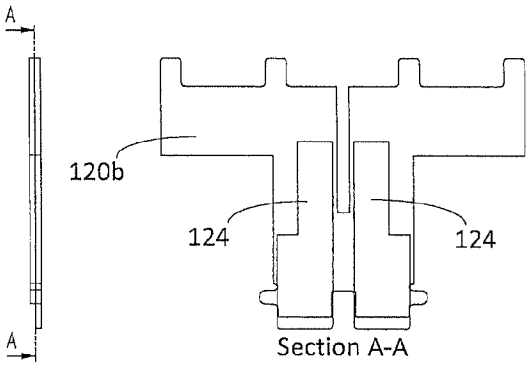
FIGS. 9*a*-9*c* illustrate radiating element feed boards according to another aspect of the present invention.
Figure 9C:
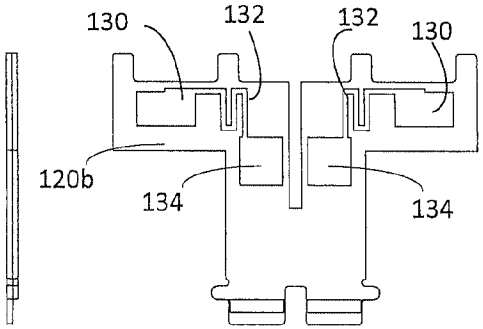
Figure 9A:
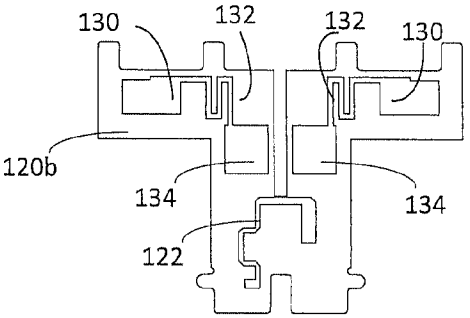

Referring to FIGS. 9*a*-9*c*, another example of a feed board 120*b* implementing a CLC matching circuit is illustrated. In this example, the first capacitors 134, inductive sections 132, and second capacitors 130 are implemented on the first and second outer layers (FIG. 9*a*, FIG. 9*c*, respectively). Hook balun 122 is implemented on the first outer layer (FIG. 9*a*). Feed sections 124 are implemented on an inner layer (FIG. 9*c*).

While FIGS. 8*a*-8*c* and 9*a*-9*c* illustrate multiple layers of metallization for maximum symmetry of the CLC matching circuit, it is contemplated that the feed boards may be implemented on non-laminated PCBs having only two layers of metallization, For example, a PCB with metallization layers as illustrated in FIG. 9*a* on one side and 9*b* on the other side.

Figure 10:
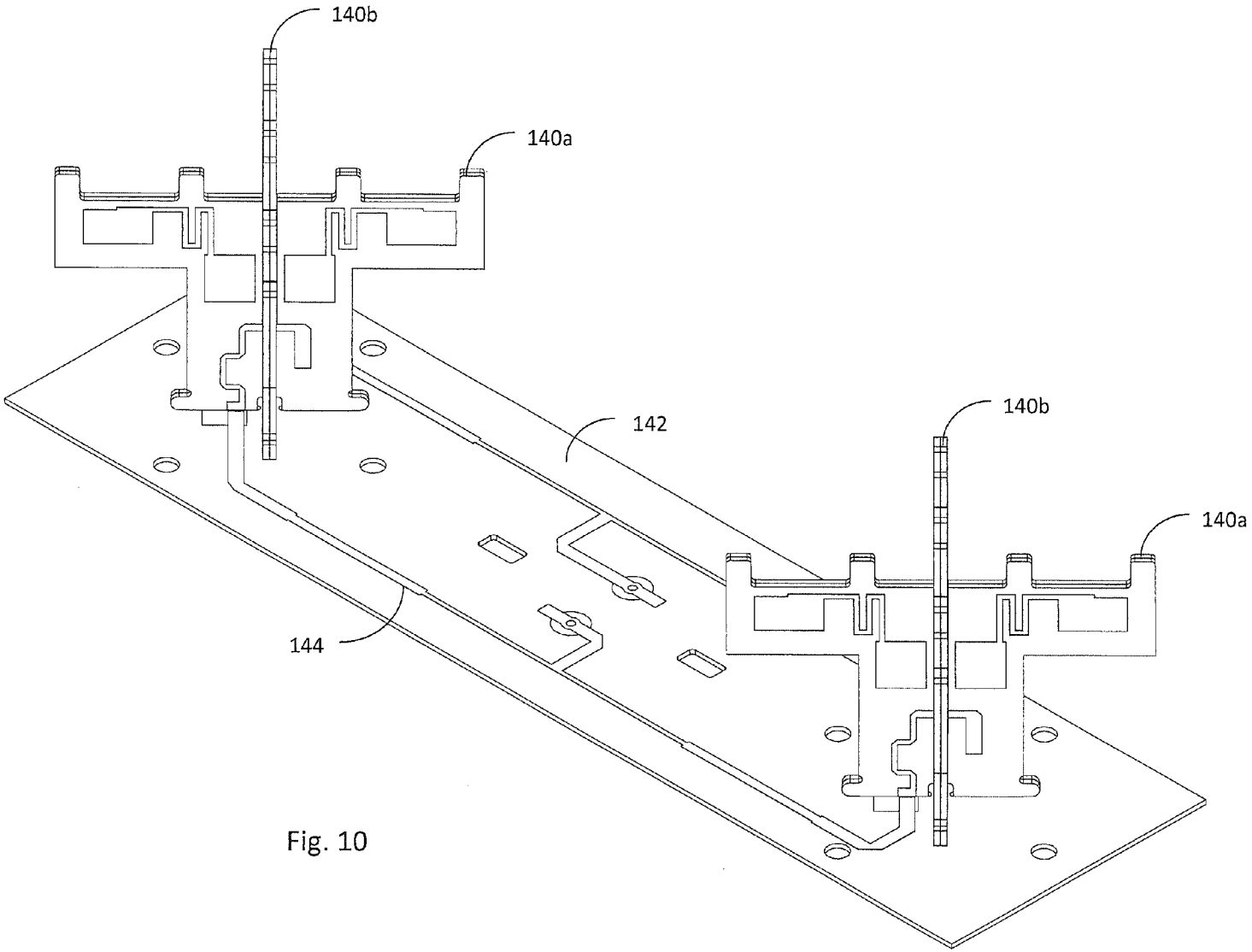
FIG. 10 illustrates the feed boards for the high impedance radiating elements arranged in an array.

FIG. 10 is an illustration of two cross dipole radiator feed boards 140*a*, 140*b* mounted on a backplane 142 including a feed network 144. The feed board PCBs 140*a*, 140*b* are configured to be assembled together via slots in the feed boards as one means of forming the supports for the radiators. There are other means of arranging the feed boards 140*a*, 140*b* as well to feed a crossed dipole. The feed boards 140*a*, 140*b* are further arranged such that radiator arms (not shown) would be a ±45 to a longitudinal axis of the backplane.

Figure 11:
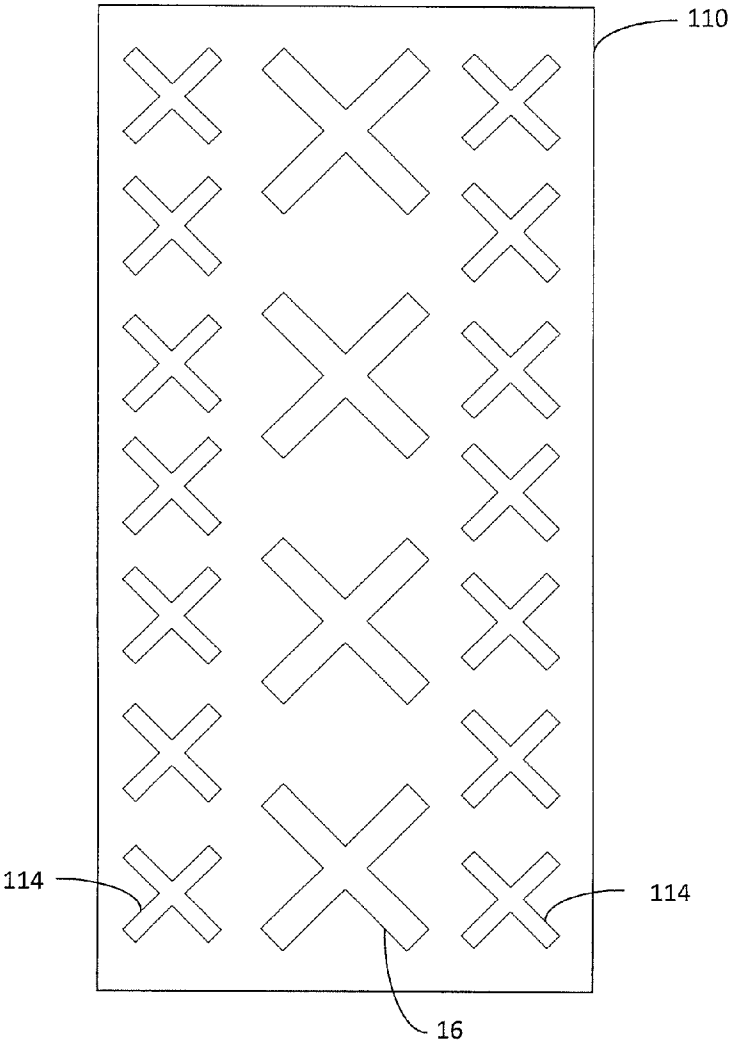
FIG. 11 illustrates a plan view of a first configuration of a dual band antenna according to the present invention.

The antenna array 110 according to one aspect of the present invention is illustrated in plan view in FIG. 11. Low band radiating elements 16 comprise conventional cross dipole elements arranged in a vertical column on reflector 12. High band elements 114 comprise high impedance cross dipole elements and are arranged in a second and third vertical column. Preferably, the high band elements have CLC coupled dipoles, as illustrated in FIG. 7.

Figure 13:
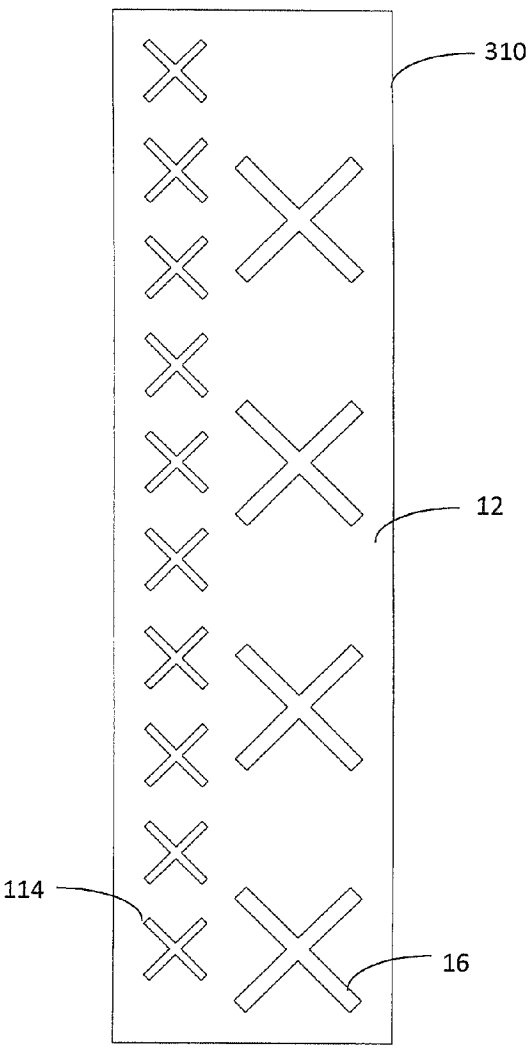
FIG. 13 illustrates a plan view of a third configuration of a dual band antenna according to the present invention.
Figure 12:
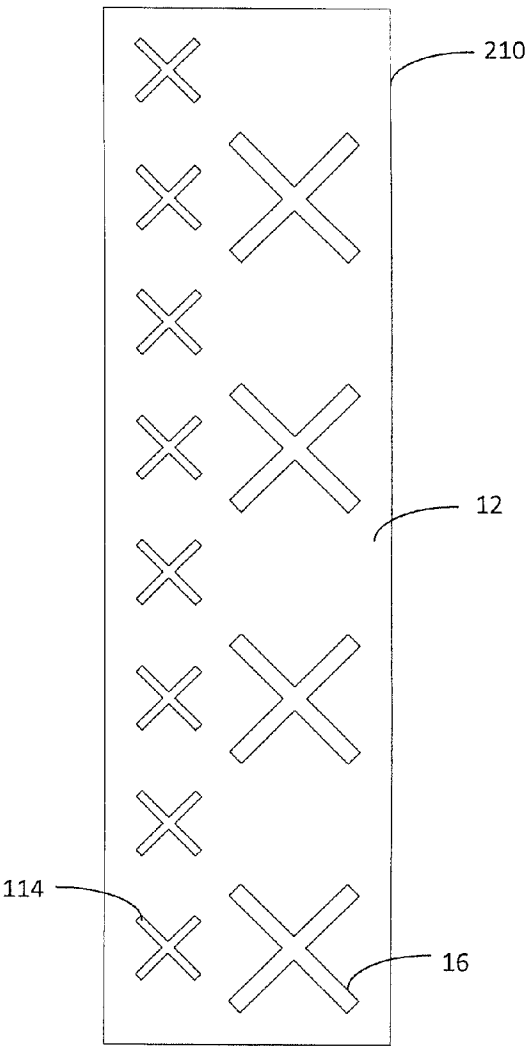
FIG. 12 illustrates a plan view of a second configuration of a dual band antenna according to the present invention.
Figure 14:
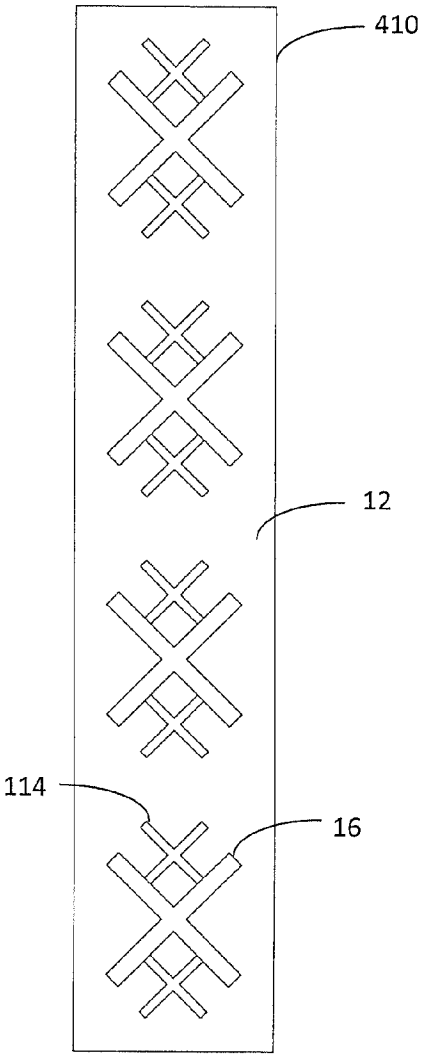
FIG. 14 illustrates a plan view of a fourth configuration of a dual band antenna according to the present invention.

The antenna array 210 of FIG. 12 is similar to antenna array 110 of FIG. 11, however, it has only one column of high band radiating elements 114. There are twice as many high band elements 114 as there are low band elements 16. The antenna 310 of FIG. 13 is similar to the antenna 210, but the high band elements are spaced more closely together, and there are more than twice as many high band elements 114 as low band elements 16. FIG. 14 illustrates another configuration of radiating elements in antenna 410. In this configuration, an array of high band elements is disposed in line with, and interspersed with, an array of low band elements 16.

The base station antenna systems described herein and/or shown in the drawings are presented by way of example only and are not limiting as to the scope of the invention. Unless otherwise specifically stated, individual aspects and components of the antennas and feed network may be modified, or may have been substituted therefore known equivalents, or as yet unknown substitutes such as may be developed in the future or such as may be found to be acceptable substitutes in the future, without departing from the spirit of the invention.

What is claimed is:

1. A multiband radiating array, comprising:

a) at least one vertical column of low band dipole elements having a first operational frequency band;

b) at least one vertical column of high band dipole elements having a second operational frequency band that is higher than the first operational frequency band and that has a midpoint frequency, the high band dipole elements having high band dipole arms that combine to be about three quarters of a wavelength of the midpoint frequency of the second operational frequency band, the high band dipole elements being supported about one quarter of a wavelength of the second operational frequency band above a planar reflector by a respective one of a plurality of the high band feed boards;

wherein each combination of a respective one of the high band feed boards and a respective one of the high band dipole arms does not resonate in the first operational frequency band.

2. The multiband radiating array of claim 1, wherein the high band dipole elements have an impedance of about 400Ω-600Ω in the second operational frequency band.

3. The multiband radiating array of claim 1, wherein the first operational frequency band is about 694 MHz-960 MHz.

4. The multiband radiating array of claim 1, wherein the first operational frequency band is about 790 Mhz-960 MHz and the second operational frequency band is about 1710 Mhz-2170 MHz.

5. The multiband radiating array of claim 1, wherein the second operational frequency band is about 1710 MHz-2170 MHz.

6. The multiband radiating array of claim 1, wherein the second operational frequency band is about 1710 Mhz-2700 MHz.

7. The multiband radiating array of claim 1, wherein the second operational frequency band is about twice the first operational frequency band.

8. The multiband radiating array of claim 1, wherein the dipole arms of the high band dipole elements are capacitively coupled to feed lines on respective ones of the plurality of the high band feed boards.

9. The multiband radiating array of claim 1, wherein each high band feed board comprises a balun and a pair of feed lines, wherein each feed line is capacitively coupled to an inductive section, and each inductive section is capacitively coupled to a respective high band dipole arm.

10. The multiband radiating array of claim 1, wherein a length of each high band dipole arm is selected so that a combination of the high band dipole arm and the high band feed board that supports it does not resonate in the first operational frequency band.

11. A multiband radiating array, comprising:

a) at least one vertical column of low band dipole elements having a first operational frequency band;

b) at least one vertical column of high band dipole elements having a second operational frequency band that is higher than the first operational frequency band and that has a midpoint frequency, each high band dipole element having a pair of high band dipole arms that combine to be about three quarters of a wavelength of the midpoint frequency of the second operational frequency band, the high band dipole elements being supported above a planar reflector by respective ones of a plurality of high band feed boards;

wherein each high band feed board comprises a balun and a pair of feed lines, wherein each feed line is capacitively coupled to a respective one of a plurality of inductive sections, and each inductive section is capacitively coupled to a respective high band dipole arm, and wherein a length of each high band dipole arm is selected so that a combination of the high band dipole arm and the high band feed board that supports it does not resonate in the first operational frequency band.

12. The multiband radiating array of claim 11, wherein the second operational frequency band is about twice the first operational frequency band.

13. A radiating element, comprising:

a. first and second dipole arms, the first dipole arm and the second dipole arm each having a respective capacitive coupling area; and b. a feedboard having a balun and first and second matching circuits coupled to the balun, the first matching circuit being coupled to the first dipole arm and the second matching circuit being coupled to the second dipole arm, wherein the first matching circuit comprises a first capacitive element, a first inductor and a second capacitive element that are arranged electrically in series, the second capacitive element being coupled to the first dipole arm, wherein the second matching circuit comprises a third capacitive element, a second inductor and a fourth capacitive element that are arranged electrically in series, the fourth capacitive element being coupled to the second dipole arm, and wherein the second capacitive element and the capacitive coupling area of the first dipole arm combine to form a capacitor that blocks out of band currents.

14. The radiating element of claim 13, wherein the first capacitive element and an area of a stalk coupled to the balun comprise parallel plates of a capacitor and a substrate of the feedboard comprises a dielectric of a capacitor that includes the first capacitive element.

15. The radiating element of claim 13, wherein the radiating element comprises a cross dipole radiating element.

16. The radiating element of claim 13, wherein a combined length of the first and second dipole arms is between 0.6 wavelengths and 0.9 wavelengths of an operational frequency band of the radiating element.

17. The radiating element of claim 13, wherein a combined length of the first and second dipole arms is about three quarters of a wavelength of a midpoint frequency of an operational frequency band of the radiating element.

* * * * *